US007392648B2

(12) United States Patent
Biermann et al.

(10) Patent No.: US 7,392,648 B2
(45) Date of Patent: Jul. 1, 2008

(54) ROTOR SPINNING MACHINE

(75) Inventors: Iris Biermann, Mönchengladbach (DE); Christoph Haase, Viersen (DE); Karl Kamps, Mönchengladbach (DE); Lorenz Kreitzen, Rheinberg (DE); Ralf Siewert, Schwalmtal (DE)

(73) Assignee: Oerlikon Textile GmbH & Co. KG, Monchengladbach (DE)

( * ) Notice: Subject to any disclaimer, the term of this patent is extended or adjusted under 35 U.S.C. 154(b) by 159 days.

(21) Appl. No.: 10/575,567

(22) PCT Filed: Oct. 18, 2004

(86) PCT No.: PCT/EP2004/011722

§ 371 (c)(1),
(2), (4) Date: Apr. 11, 2006

(87) PCT Pub. No.: WO2005/035843

PCT Pub. Date: Apr. 21, 2005

(65) Prior Publication Data

US 2007/0130906 A1 Jun. 14, 2007

(30) Foreign Application Priority Data

Oct. 16, 2003 (DE) ..... 103 48 709

(51) Int. Cl.
*D01H 13/32* (2006.01)

(52) U.S. Cl. ..... 57/264; 700/139

(58) Field of Classification Search ..... 57/264; 700/139

See application file for complete search history.

(56) References Cited

U.S. PATENT DOCUMENTS

| | | | | |
|---|---|---|---|---|
| 5,509,261 | A | 4/1996 | Wassenhoven et al. | 57/263 |
| 6,381,511 | B1 * | 4/2002 | Hermanns et al. | 700/139 |
| 6,564,537 | B2 * | 5/2003 | Galan Pujol | 57/75 |
| 6,574,526 | B1 | 6/2003 | Gaukler et al. | 700/139 |

FOREIGN PATENT DOCUMENTS

| | | | |
|---|---|---|---|
| DE | 44 04 503 | A1 | 9/1994 |
| DE | EP 1 054 086 | A1 | 11/2000 |
| EP | 1 002 891 | A2 | 5/2000 |

* cited by examiner

*Primary Examiner*—Shaun R Hurley
(74) *Attorney, Agent, or Firm*—Kennedy Covington Lobdell & Hickman, LLP

(57) ABSTRACT

A rotor spinning machine has a plurality of spinning stations, each of which comprises an opening roller and a draw-in roller for supplying sliver to the opening roller and each of which is equipped with control devices for individual drives of the draw-in rollers. The control devices each have a connection mechanism, to which an additional control card can be attached for producing effect or novelty yarn with predetermined effects. The control card comprises a processor, which meets the elevated computing power requirements for producing effect or novelty yarn and can be activated via a data bus system.

5 Claims, 3 Drawing Sheets

ROTOR SPINNING MACHINE

CROSS-REFERENCE TO RELATED APPLICATIONS

This application claims the benefit of German patent application 10348709.3, filed Oct. 16, 2003, herein incorporated by reference.

BACKGROUND OF THE INVENTION

The invention relates to a rotor spinning machine and, more particularly, to a rotor spinning machine with a plurality of spinning stations, each of which comprises an opening roller and a draw-in roller for supplying a fiber band, such as a sliver, to the opening roller and control devices for individual drives of the draw-in rollers.

In the production of yam, a uniformity of the yarn which is as high as possible is generally aimed for within narrow tolerances. In contrast, the non-uniformity of the yarn is characteristic of effect or novelty yarns. A yarn, in which thick locations with predetermined larger diameters and with predetermined lengths, the so-called effects, are present, is called an effect or a novelty yarn. The yarn sections located in between with a smaller diameter are called webs. Effect or novelty yarns are becoming more and more important. Areas of application are, for example, denims, materials for casual clothing and home textiles.

Effect or novelty yarns can also be produced on rotor spinning machines. In order to produce effects in the yarn on rotor spinning machines, the sliver feed to the opening roller of the rotor spinning device is changed, for example, in that the speed of the take-in rollers is varied. Mechanical gearings, which drive shafts which extend along the length of the machine, are activated for this purpose. The draw-in rollers are made to rotate by means of these shafts. However, due to the large mass of the moved parts of a drive system of this type and the gearing play, a precise and abrupt change in the yarn thickness cannot be achieved, or only with difficulty, at the beginning and end of an effect. The speed during spinning of effect or novelty yarn optionally has to be sharply reduced compared to the speed when spinning effect-free yarn.

The basic German Patent Publication DE 44 04 503 A1 describes a rotor spinning machine, in which each draw-in roller with its drive shaft is directly connected to an associated stepping motor. Each stepping motor can be activated via an activation unit. Random speed changes of the sliver draw-in can be generated with a random generator. An effect or novelty yarn with predetermined effects cannot be produced with this known rotor spinning machine.

In order to set up a rotor spinning machine in such a way that it is possible to produce effect or novelty yarn with predetermined properties of the effects, a substantially outlay with corresponding costs for control devices and optionally also for the drives is necessary. For costs reasons, an outlay of this type is dispensed with in new rotor spinning machines, if the intention is not to spin effect or novelty yarn at the time of purchasing the machine. Thus, until now, only a small proportion of rotor spinning machines corresponding to the production proportion of effect or novelty yarn in the overall production of yarn has been equipped for the production of effect or novelty yarn. Since, in taking up the production of effect or novelty yarn, instead of new machines, it is often desired for economic reasons to use existing rotor spinning machines, which are however not accordingly equipped, and high costs are incurred for retrofitting. Control devices, which are adequate for controlling the production of effect-free yarn, are also not in a position to assist the production of effect or novelty yarn.

SUMMARY OF THE INVENTION

The object of the invention is to reduce the drawbacks described above in setting up a rotor spinning machine for the production of effect or novelty yarn.

This object is achieved with a rotor spinning machine having a plurality of spinning stations, each of which comprises an opening roller and a draw-in roller for supplying sliver to the opening roller and each of which is equipped with control devices for individual drives of the draw-in rollers. According to the invention, the control devices each have a connection mechanism, to which an additional control card can be attached for producing effect or novelty yarn with predetermined effects. The control card comprises a processor, which meets the elevated computing power requirements for producing effect or novelty yarn and can be activated via a data bus system.

Advantageous further developments of the invention are described below.

With a rotor spinning machine as above-described, rapid, economic retrofitting of a rotor spinning machine for the production of effect or novelty yarn with predetermined effects is possible. The change to batches with other effects can easily be carried out in rotor spinning machines according to the invention by reading the effects into the central control and transmitting the data required via a data bus system to the control card. A change of the control card is not necessary for this purpose.

The control cards in each case control a plurality of spinning stations, without the production of effects being impaired by the quantity of the data to be transmitted, as could occur in the activation of all individual drives of the draw-in rollers of a rotor spinning machine from a standard control device. It is particularly favorable here if a control device in each case controls a section of the rotor spinning machine formed from a group of spinning stations. An allocation of the spinning stations, which in each case belong to a group, to one machine side of the rotor spinning machine facilitates the supply and removal of the sliver cans and the finished yarn. On one machine side, effect or novelty yarn can be spun and on the other machine side flat yarn may be spun simultaneously.

The connection mechanism may be set up in such a way that the basic functions of the control device for producing effect-free yarn are switched off with the connection of the control card and the control card is configured for alternatively carrying out of the functions for the production of effect-free yarn and the production of effect or novelty yarn. In such a rotor spinning machine, after connection of the control card during the change from the production of effect or novelty yarn to the production of effect-free yarn and vice versa, no change of the control card is necessary, but rather the change in production may take place by a simple control command to the control card.

The rotor spinning machine according to the invention allows a rapid, simple and economical setting up for the production of effect or novelty yarn with a problem-free change of batch. The arrangement of the control card on the control device for a section of the rotor spinning machine allows the change in the yarn between webs and effects to be carried out in a precisely controlled manner even at high yarn speeds. The single-motor drive of the draw-in rollers avoids the disadvantages of gearings, which consist in delays in the implementation of the control commands and an increased energy output due to energy losses in the gearings.

BRIEF DESCRIPTION OF THE DRAWINGS

Further details of the invention can be seen in the figures, in which.

DESCRIPTION OF THE PREFERRED EMBODIMENTS

Figure 1:
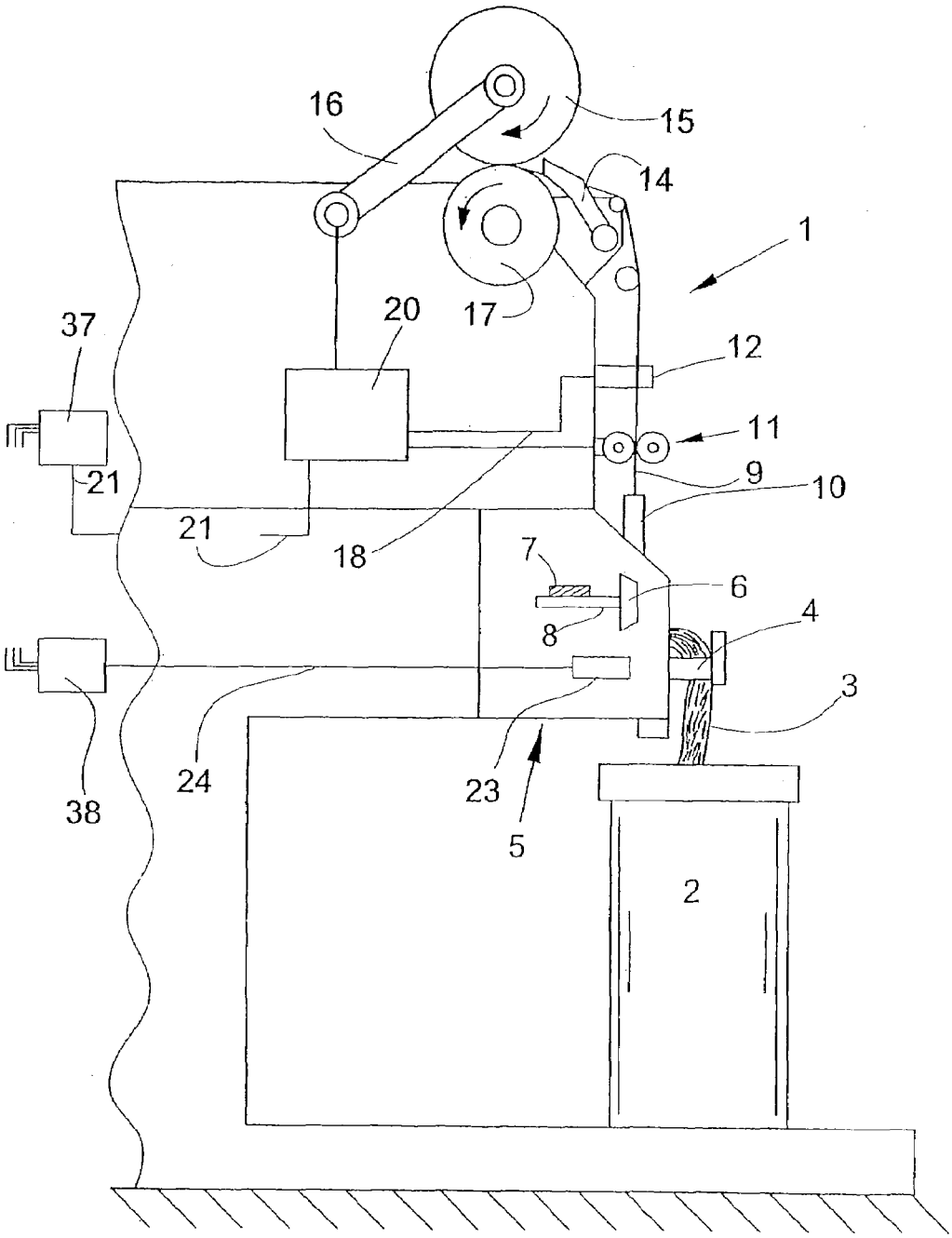
FIG. 1 shows a schematic view of a spinning station.

From the plurality of spinning stations of a rotor spinning machine, a single spinning station 1 is shown in side view. At the spinning station 1, a sliver 3 is drawn from a sliver can 2 through a so-called compressor 4 into the spinning box 5 of the rotor spinning device. The device arranged in the spinning box 5 for separating the fibers and feeding them into the spinning rotor 6, are known from the prior art and therefore not described in more detail. The drive of the spinning rotor 6 is indicated and consists of a belt 7 extending along the machine, with which all the rotors of the spinning stations installed on a longitudinal side of the spinning machine are driven. Alternatively, single drives for the rotors are also possible, however. The belt 7 lies on the rotor shaft 8 of the spinning rotor 6.

The thread 9 is formed in the spinning rotor 6 and is drawn off through the thread draw-off tube 10 by means of the draw-off rollers 1. The thread 9 then passes a sensor 12, the so-called cleaner, for quality monitoring of the thread. The thread 9 is guided by a thread guide 14 in such a way that it is wound onto a cross-wound bobbin 15 in cross-wound layers. The cross-wound bobbin 15 is carried by a bobbin holder 16, which is pivotably mounted on the machine frame. The cross-wound bobbin 15 rests with its periphery on the winding drum 17 and is driven thereby such that the thread 9, in cooperation with the thread guide 14 is wound in cross-wound layers. The rotational directions of the cross-wound bobbin 15 and the winding drum 17 are indicated by arrows. The sensor 12 is connected to a local control unit 20 of the spinning station via the line 18. The control unit 20 is connected to a central computer 37 of the rotor spinning machine via the line 21. The stepping motor 23 of the draw-in rollers is connected to the control device 38 via the line 24.

Figure 2:
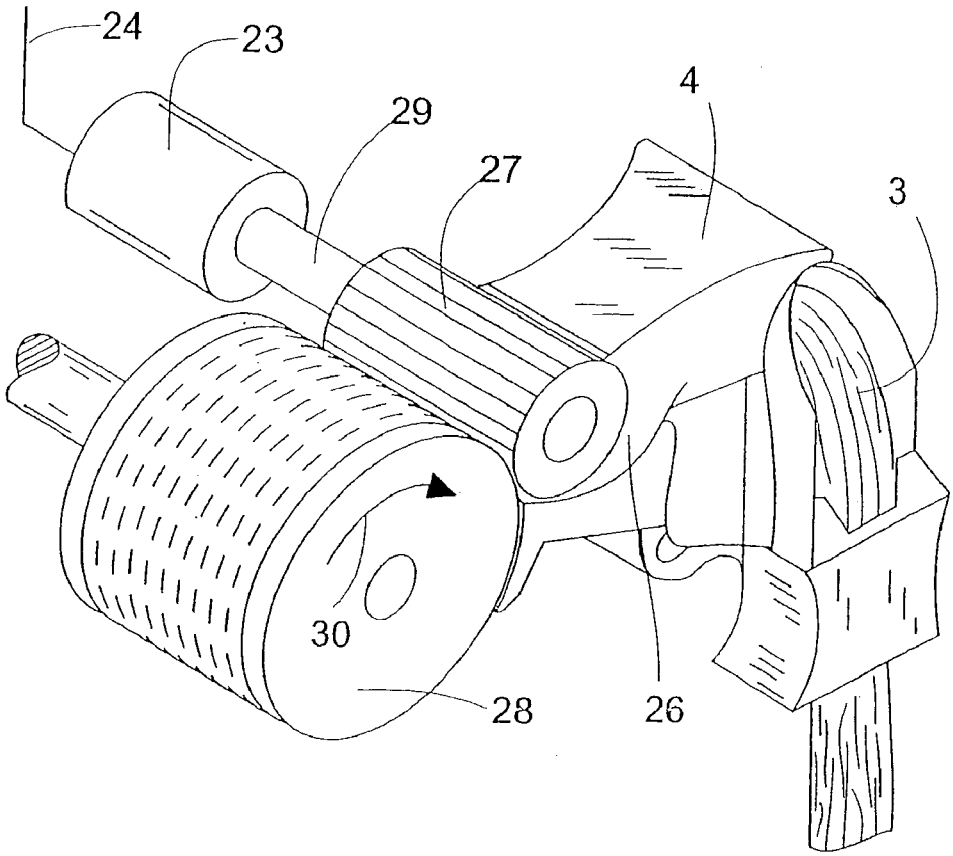
FIG. 2 shows the opening device of a spinning station in a simplified schematic view, in partial view.

FIG. 2 shows details of the opening of the sliver 3 into individual fibers. The sliver 3 drawn in by the compressor 4 is clamped between the clamping table 26 and the draw-in roller 27 and presented to the rapidly rotating opening roller 28. The draw-in roller 27 is connected to the stepping motor 23 via the drive connection 29. The stepping motor 23 can be activated by the line 24. The rotational direction of the opening roller 28 is indicated by the arrow 30.

Figure 3:
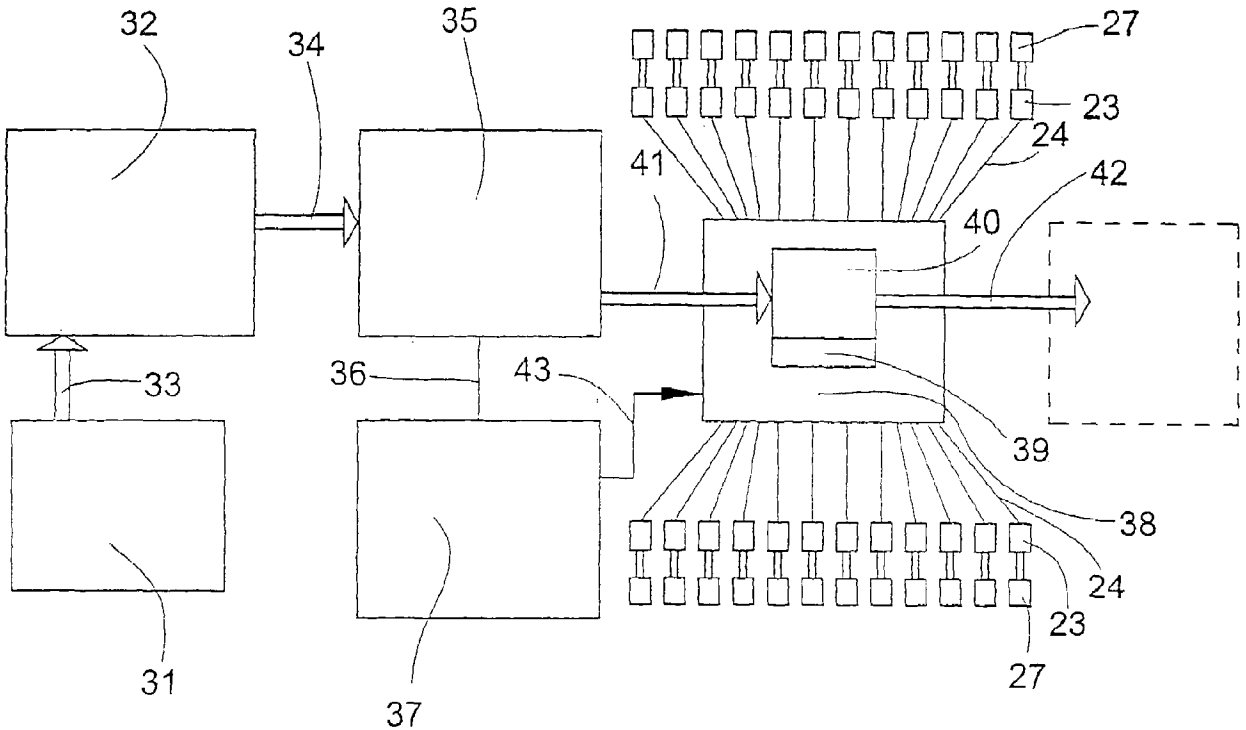
FIG. 3 shows a basic view of the control of draw-in rollers of a rotor spinning machine.

The basic construction of the drawn-in roller control according to the invention is shown schematically in FIG. 3.

This data is transmitted to a yarn design unit 32 by a unit 31 for generating data, which characterizes a specific effect or novelty yarn. The transmission is indicated by the arrow 33. In the yarn design unit 32, the data required for spinning on a rotor spinning machine is generated by means of yarn design software. This data includes both the direct effect-related data which varies with the changing diameter of the yarn and also further data relating to the basic adjustment of the rotor spinning machine. This is, for example, the rotor, draw-off roller and opening roller speed and the selection of the spinning means. While the latter can be preferably retrieved from a table, the speeds have to be determined by corresponding algorithms. These algorithms are based on known connections. This involves, for example, the determination of the drawing from the ratio of the speeds of the take-off rollers to the speed of the draw-in rollers or the rotations per meter from the rotor speed to the draw-off speed and the constriction of the fiber assembly connected therewith.

The data generated in the yarn design unit 32 is transmitted via the data bus system 34 to a central control device 35 of the rotor spinning machine. Transmission may also alternatively take place with transportable data carriers, such as, for example a compact flash card.

The central control device 35 is connected to the central computer 37 via the data line 36. The control device 38 comprises the control of two groups of, in each case, 12 stepping motors 23 of the respective draw-in rollers 27 via lines 24. All 24 spinning stations are constructed in the same manner. A control card 40 is connected on the control device 38 by means of the connection mechanism 39. The data for the control of the stepping motors 23, required for the production of the effect or novelty yarn, is transmitted by the central control device 35 via the data bus system 41 to the control card 40. The control card 40, for the production of effect or novelty yarn, converts the data about thickness and length of the effects and the webs, with adaptation to the other spinning adjustments, into control data for the stepping motors 23 to produce the rotary movement of the draw-in rollers 27.

The large data quantities required can be transferred very rapidly with a data bus system. Suitable data bus systems have been developed for the requirements of automated systems. The data required to control the stepping motors of the draw-in rollers is transmitted to further control cards, not shown, which are connected to control devices of further sections of the rotor spinning machine via the data bus system 42, as a continuation of the data bus system 41. One of the further control devices is shown by dashed lines. The further control devices are constructed like the control device 38 and have the same connection mechanism and the same connected control card. Each further control device in each case controls the spinning stations of a section of the rotor spinning machine formed from two groups each with 12 spinning stations.

If the stepping motor 23 is activated in such a way that it runs more quickly, the draw-in roller 27 transports more fiber material to the opening roller 28. This results in the fact that more fiber material arrives, per time unit, in the rotor 6 and the fiber spun becomes thicker. The length of the thick location depends on the duration of the increased sliver supply. The diameter of the thick location depends on the speed of the stepping motor 23 or the draw-in roller 27.

The control device 38 is activated by the central computer 37 via the line 43 when it is specified via control commands as to whether the control device 38 alternatively controls the production of effect or novelty yarn or the production of effect-free yarn. With the control of 24 spinning stations by the control device 38, compared to control of all spinning stations directly by the central computer 37, an inertia in the control of the draw-in rollers is avoided, which may occur due to delays in the data transmission. On the other hand, the number of control devices 38 required for a rotor spinning machine together with a control card 40, is limited and the outlay for construction is thus kept within an economical framework.

The retrofitting of a rotor spinning machine which is set up initially only for the production of effect-free yarn, into a machine, with which effect or novelty yarn can be produced, can be easily implemented. The connection mechanism can be designed as a plug mechanism and the control device 38 and the control card 40 can be configured as conductor cards. For the switching over of effect-free yarn to effect or novelty yarn in the case of a batch change, no manual intervention is necessary to exchange control cards 40 but rather the change takes place, as described above, by means of a control command of the central computer 37.

The invention is not limited to the embodiment shown. Alternative embodiments are possible within the scope of the concept of the invention.

The invention claimed is:

1. Rotor spinning machine with a plurality of spinning stations, each of which comprises an opening roller and a draw-in roller for supplying sliver to the opening roller and each of which is equipped with a control devices for an individual drive of the draw-in roller, characterized in that each control device (38) has a connection mechanism (39), to which an additional control card (40) can be attached for producing effect or novelty yarn with predetermined effects, the control card comprising a processor, which meets the elevated computing power requirements for producing effect or novelty yarn and can be activated via a data bus system (41).

2. Rotor spinning machine according to claim 1, characterized in that the control device (38) is connected to a central computer (37) of the rotor spinning machine.

3. Rotor spinning machine according to claim 1, characterized in that each control device (38) controls the individual drives of a group of spinning stations (1) of the rotor spinning machine.

4. Rotor spinning machine according to claim 3, characterized in that each group of spinning stations (1) is associated in each case with one of the two machine sides of the rotor spinning machine.

5. Rotor spinning machine according to claim 1, characterized in that the connection mechanism (39) is set up in such a way that the basic functions of the control device (38) for producing effect-free yarn are switched off with the connection of the control card (40) and the control card (40) is configured for the alternative carrying out of the functions for the production of effect-free yarn and the production of effect or novelty yarn.

* * * * *